United States Patent [19]

Usami

[11] 3,946,583

[45] Mar. 30, 1976

[54] METHOD AND APPARATUS FOR IMPROVING FATIGUE STRENGTH IN WELD ZONES

[75] Inventor: Saburo Usami, Hitachi, Japan

[73] Assignee: Hitachi, Ltd., Tokyo, Japan

[22] Filed: Mar. 20, 1975

[21] Appl. No.: 560,208

[30] Foreign Application Priority Data

Mar. 20, 1974 Japan ..... 49-31869

[52] U.S. Cl. ..... 72/54; 29/421 R; 228/157

[51] Int. Cl.[2] ..... B21D 26/04

[58] Field of Search ..... 228/199, 157; 29/421; 72/56, 54

[56] References Cited

UNITED STATES PATENTS

| | | | |
|---|---|---|---|
| 2,993,263 | 7/1961 | Staples | 72/54 X |
| 3,238,610 | 3/1966 | Berg | 72/54 X |
| 3,895,436 | 7/1975 | Summers et al. | 228/157 |

*Primary Examiner*—Milton S. Mehr
*Attorney, Agent, or Firm*—Thomas E. Beall, Jr.

[57] ABSTRACT

In a weld for two metals having adjacent surfaces with a welded zone having deposited weld metal and an unwelded zone with a stress concentration between the two zones that would normally drastically decrease the fatigue strength, the fatigue strength is greatly improved by applying a preliminary load on the welds zone by the application of a fluid pressure between the unwelded adjacent surfaces to directly stress the stress concentration transition area. Preferably, the stress intensity factor for the fluid pressure at the stress concentration zone will be higher than the combined tensile and flexural stress intensity factors so that there will be localized yielding at the stress concentration area without damaging the remainder of the weld. The metal and/or fluid is heated to avoid fracture and further to vaporize any liquid remaining once the fluid pressure is removed.

9 Claims, 4 Drawing Figures

METHOD AND APPARATUS FOR IMPROVING FATIGUE STRENGTH IN WELD ZONES

BACKGROUND OF THE INVENTION

The invention relates to a method and apparatus for improving the fatigue strength in weld zones of any of welded structures.

The technique of forming one complete article by bonding two or more parts through welding is employed for the manufacture of various products in substantially all of the technical fields. However, the welding parts of large dimension requires a number of steps, and therefore, various disadvantages are brought about. More specifically, according to an ordinary welding method, a weld metal is deposited and embedded or fused in portions of the two parts that are to be bonded, and the portions are bonded to each other by the deposited weld metal. Accordingly, in order to faciltate embedding of the weld metal in the portions to be bonded and impart a sufficient strength to the bonded portions with respect to large pieces of metal, it is necessary to shape the exposed area of the adjacent faces so that the weld metal may reach the interior of the adjacent surfaces or faces. This is conventionally accomplished by forming a groove that is V-shaped or U-shaped at the exposed area of the adjacent surfaces to be bonded to assist in depositing the weld metal to the interior of the adjacent surfaces. In general, the embedding or penetration of the weld metal into such a V-shaped or U-shaped groove is accomplished by melting a welding rod at the bottom of the groove. When the parts to be bonded have very large dimensions, the size of the V-shaped or U-shaped groove into which the weld metal is embedded and penetrated, such naturally be increased according to the conventional method and the embedding of the weld metal by using the welding rod should be conducted repeatedly so as to build up successive layers of deposited weld metal in order to fill such a large dimensioned groove. Therefore, many steps are required for the formation of such a weld joint employing a V-shaped or U-shaped groove for large dimensioned materials, wherein weld metal is embedded and penetrated.

If the size of such V-shaped or U-shaped groove for the embedding of a weld metal is diminished beyond what is necessary to accomplish complete penetration of the weld metal into the clearance between the adjacent surfaces, it is then possible to reduce the number of steps for welding the parts to be bonded and further to reduce the frequency of repeating the metal depositing that would be required to fill up the groove through successive deposits. However, the strength of the weld would correspondingly decrease.

In short, according to conventional welding methods, a groove is formed in the welding zone between the parts to be bonded, and with large dimensioned parts there are formed areas in which weld metal is deposited and areas in which weld metal is not deposited between the adjacent surfaces of the two parts to be joined.

In such welded structure, the non-deposited portions in the finished product behave as if they were cracks in metal parts, and when an external force is imposed in the bonded portions, the stress is concentrated at the top ends of such cracks, which will have a notch effect at the roots of the non-deposited portions, and the fracture is accelerated in the weld zone, particularly with respect to fatigue strength. Therefore, the fatigue strength is very low in such a structure.

As a means for improving the fatigue strength in the weld zone of such welded structures, there is known a method in which an external force greater than the external force to be imposed on the welded structure at the actual application is imposed on the weld zone temporarily in advance to actual use of the structure.

More specifically, an external force is imposed on a metal having cracks in such a direction that the cracks are enhanced, whereby a stress concentration on the end portions of the cracks is caused to form a zone locally yielded due to reaching the yielding stress. When application of the external force is stopped in this state, a zone reversely yielded is formed in the end portions of the cracks. Namely, when a tensile force is applied as the external force enhancing the cracks, a tensile-yielding zone is formed in the end portions of the cracks, but when this external force is removed, a compression-yielded zone is formed because of the restraint from the remaining unyielded portions of the metal.

After such treatment when a concentrated stress by an external force is imposed during actual operations and is smaller than the concentrated stress by the above-mentioned preliminary applied external force, an action of confining the crack is manifested by the compression-yielded zone and as a result, the fatigue strength is improved. As described above, it is known that the fatigue strength can be improved if an external force greater than the external force imposed on a welded structure at the actual application when in use is preliminarily imposed to the unwelded portion of a weld zone. However since it is difficult to apply an appropriate external force to a weld zone having an unwelded portion, this known method is not usually practical and is hardly ever employed.

For example, it is considered that a necessary external force may be obtained by attaching a welded part having an unwelded portion to a rotary shaft, rotating the part together with the shaft utilizing a centrifugal force generated by the rotation. According to this method, however, it seldom happens that the external force is effectively imposed only on the unwelded portion, but an excessive external force is supplied even to an unnecessary portion, that is a portion that need not be yielded and is outside of the stress concentration zone so that the part will become damaged. Accordingly, it is very difficult to adjust the external force to be applied to the unwelded portion while controlling appropriately the external force to be applied to a portion outside of the stress concentration zone.

It has also been considered that an external force may be applied by using an oil pressure jack. But according to this method, it is difficult to apply a necessary external force to the appropriate portion. Further, since an external force greater than an external force to be imposed when the product is actually put into use, must be employed for this preliminary treatment, it is necessary to take great care not to damage the welded portion.

SUMMARY OF THE INVENTION

It is a primary object of the present invention to provide a method and apparatus for improving the fatigue strength in a weld zone having an unwelded portion, whereby the number of operating steps required for welding can be greatly reduced as compared to the formation of a weld not having an unwelded portion. According to the present invention, a fluid pressure is applied to the clearance between the parts in the unwelded zone formed by the unwelded adjacent surfaces to obtain a desired external force with ease to locally yield the stress concentration zone beyond what would be obtained in actual use with ease, and fracture of the bonded portion is prevented by application of heated fluid that has been heated to a suitable temperature for this purpose.

BRIEF DESCRIPTION OF THE DRAWING

Further objects, features and advantages of the present invention will become more clear from the following detailed description of the drawing, wherein.

DETAILED DESCRIPTION OF THE PREFERRED EMBODIMENTS

Figure 1:
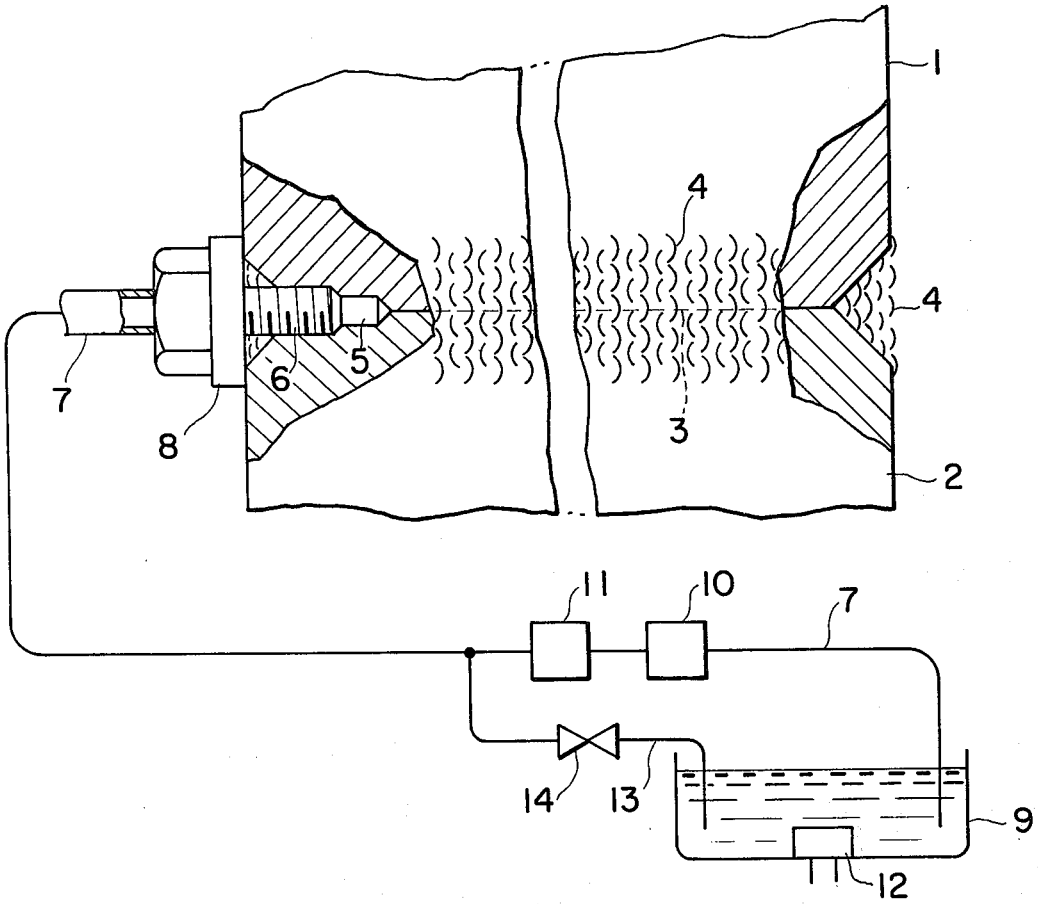
FIG. 1 is a diagram illustrating the method and apparatus for improving the fatigue strength in an unwelded portion in a structure formed by welding two metal parts in end abutting relationship across their thickness.

With reference to FIG. 1, the metal parts 1 and 2 have adjacent surfaces perpendicular to the plane of FIG. 1 forming edge faces with a thickness as illustrated, wherein they are to be welded at their edges. At one exposed portion of the surfaces, the edges of each metal part 1 are chamfered to form a V-shaped groove as shown at the right in FIG. 1. During the welding of the metal parts 1 and 2 to bond them to each other, the V-shaped groove is filled with weld metal 4, which weld metal 4 is only deposited in the groove along the adjacent edges of the parts 1 and 2 running in a line perpendicular to FIG. 1. The other side and opposite ends may also contain weld metal 4 as applied in a V-shaped groove, as shown in partial cross section, the weld metal does not extend to the interior of the adjacent surfaces of the parts 1 and 2, so that the adjacent surfaces 3 wherein the V-shaped groove does not reach, are not welded together and form a clearance and an unwelded portion. The zone between the unwelded portion, defined by the adjacent surfaces 3 having a clearance therebetween and the welded portion defined by the deposition and fusion of the weld metal 4 forms a transition zone having stress concentration. Effectively, the two parts 1 and 2 thus welded together become one part having therebetween a crack at 3 with stress concentration at the end of the crack at the beginning of the deposited weld metal 4.

After the weld metal 4 has been deposited and fused in the V-shaped groove, one or a plurality of holes 5 are drilled or formed into the structure to reach between the unwelded surfaces or faces 3, tapped and thereafter receive a screw fluid fitting 6 to form a fluid inlet for each hole 5. A fluid line fitting 8 is assembled with the screw fitting 6 so that one end of a fluid line or conduit 7 may be fluid connected by the screw 6 and fitting 8 to the unwelded portion between the surfaces 3. The other end of the conduit 7 is fluid connected to an oil storage tank 9 and provided intermediate its ends with a pump 10 and a pressure gauge 11. A conventional heating device 12 is preferably employed in the oil storage tank 9 to heat the oil in the tank 9 and maintaining the temperature of the oil in the tank 9 at an appropriate level. The oil temperature may sometimes have bad effects upon the pump 10, and in such cases, the heating device 12 may be disposed at a point downstream from the pump 10 and closer to the fitting 8. A bypass line 13 is branched from the conduit 7 to lead to the oil storage tank 9 and has therein a valve 14.

In operation, the weld metal 4 is deposited in the V-shaped groove and the hole 5 is formed to suitably attached the conduit 7. Thereafter, the pump 10 is operated to feed the oil under pressure to the clearance between the surfaces 3, with the oil being supplied by the storage tank 9. The effect this has upon the weld will now be discussed.

The material welded as shown in FIG. 1 with the welded portion and a central unwelded portion, will effectively become an integral piece of metal 20 with a central crack 21 having a crack length $2a$.

Figure 3A:
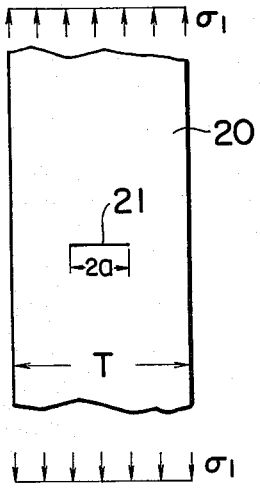
FIG. 3 is a diagram showing the application of external forces on a weld having an unwelded portion to illustrate the amount of pressure to be applied by the fluid for treatment according to the present invention.
Figure 3B:
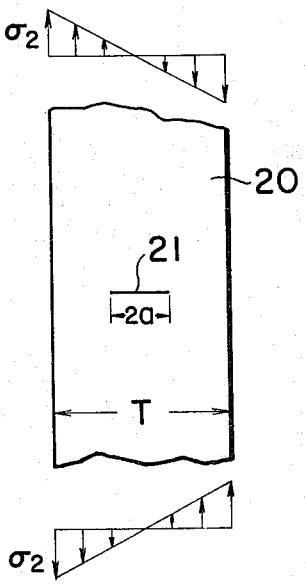

In the case where a tensile stress $\sigma_1$ is uniformily applied to the member 20 as shown in FIG. 3$a$, the stress intensity factor $K_1$ on the crack 21 is represented as follow:

$$K_1 = \sigma_1 \sqrt{\pi a} \quad (1)$$

In the case where a flexural stress $\sigma_2$ is applied as shown in FIG. 3$b$, the stress intensity factor $K_2$ on the crack 21 is represented as follows:

$$K_2 = a\sigma_2 \sqrt{\pi a}/T \quad (2)$$

In the above formulae, $T$ represents the width of the member 20 and a represents ½ of the length of the crack.

When a pressure $P$ is applied to the inside of the crack 21 as shown in FIG. 1, the stress intensity factor $K_p$ is represented as follows:

$$K_p = P\sqrt{\pi a} \quad (3)$$

Since both a tensile stress and a flexural stress are usually simultaneously imposed on a member when put into use, in order to make $P$ greater than the sum of $K_1$ and $K_2$ according to the present invention, it is necessary to establish the following relationship:

$$P > \sigma_1 + \sigma_2 a/T \quad (4)$$

The oil under pressure is fed to the clearance between surfaces 3 with the pressure being regulated according to gauge 11 and valve 4 if needed so that the pressure of the fluid being supplied to the unwelded zone will be according to the above formula (4). After a tensile-yielded area is thus formed in the stress concentration zone between the unwelded portion and the welded portion by the application of the fluid pressure, the pump 11 is stopped and the oil is returned to the oil storage tank 9 by opening the valve 14. Thereafter, the fitting 8 is disassembled and the screw 6 is sealed with a plug or by welding. If the fitting 8 is not necessary, such a fitting may be omitted.

After the metal within the stress concentration zone has tensile yielded due to the application of the static tensile stress by the fluid pressure, removal of the fluid pressure will produce a compression stressed or yielded area within the stress concentration zone due to the presence of the surrounding metal that was not tensile yielded but only elastically deformed. Thus, the fatigue strength of the welded structure will be increased.

When the oil fed to the clearance between the surfaces 3 is appropriately heated, the toughness of the weld metal is improved and the heating of the oil is effective for the prevention of fracture by the oil pressure.

As a specific example of the present invention, when mild steel plates having a thickness of 200 mm and a tensile strength of 41Kg/mm$^2$ were welded to form an unwelded portion or a zone having a width of 100 mm and thereafter the welded structure was annealed, it was found that the limiting fatigue strength was 2Kg/mm$^2$. When an oil pressure of 16Kg/mm$^2$ was applied to the unwelded portion for ten seconds by using the above method and apparatus, the limiting fatigue strength was increased to 8Kg/mm$^2$. It was found that the tensile strength was not adversely effected by applying the above oil pressure to the unwelded portion for the above-mentioned time.

Figure 2:
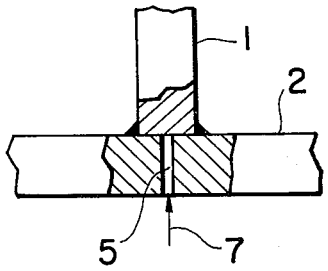
FIG. 2 is a diagram illustrating the present invention as employed with respect to a T-shaped weld.

FIG. 2 illustrates an embodiment of the present invention where two metal parts are welded to each other in a T-shaped configuration. In this embodiment, the hole 5 may be drilled through the plate 2 parallel to the plate 1 to reach the unwelded zone, and it is unnecessary for the hole 5 to be drilled through any of the deposited weld metal as in FIG. 1 to reach the clearance area between the unwelded surfaces 3. The result in FIG. 2 is substantially the same as the result of the weld in FIG. 1 with respect to the present invention in that a bonded integral structure is obtained wherein effectively the central unwelded portion functions as a crack with respect to producing a stress concentration area between the unwelded portion and welded portion of the adjacent surfaces. Thus, the above analysis equally applies to the structure of FIG. 2.

According to the present invention, even if an unwelded portion is formed in a weld zone, a sufficient fatigue strength can be obtained. Further, the metal outside of the stress concentration area is not adversely effected by the oil pressure being applied according to the present invention and the pressure can be imposed only to the necessary clearance faces in the unwelded zone. Therefore, it is unnecessary to chamfer the edges of the members to be joined to obtain a groove to a sufficient extent that the weld metal may be deposited over the entire area of the adjacent surfaces as has been the practice in the past to avoid an unwelded portion, because the present invention by relieving the metal within the stress concentration zone can permit depositing of weld metal in smaller grooves with the result of an unwelded portion without suffering the usual drastic reduction in the fatigue stength caused by such unwelded portions. Therefore, the number of steps required for forming the welding zone can be greatly reduced and the amount of weld metal deposited can also be reduced, when comparing welding across the entire adjacent surfaces with welding only in shallower grooves with the formation of an unwelded zone.

In the foregoing embodiments, oil is used as the pressure medium, but according to the broader aspects of the present invention, any other fluid, for example water or air, can be used.

The fluid is preferably heated to a high temperature when used to pressurize the unwelded zone in order to prevent brittle fracture under application of the fluid pressure, and further to vaporize any fluid (when liquid is employed as the pressurizing medium) left in the unwelded zone after the pressure has been removed. As specific examples for heating the fluid to be used for maintaining the unwelded portion at a relatively high temperature, reference is made to the following:

1. A weld joint is withdrawn at a temperature of about 200° C from an annealing furnace, and in this state pressurized water is fed to the screw holes 5. In this case, the screw holes may be disposed only on one side. In case annealing is not conducted, the residual heat left from the previous welding operation may be utilized, or only the joint portion may be heated with an external burner after the welding operation is completed.

2. A heated fluid is fed through the screw holes 5 on one side by a pump 10, and the fluid leaving screw holes on the opposite side of the unwelded zone is heated and recycled. When the unwelded portion is thus heated to about 100° to 200° C, the valve 14 disposed in the fluid return passage is closed and the fluid will be pressurized by the pump 10 to in turn pressurize the unwelded zone.

As shown in FIG. 2, it is not always necessary to chamfer the bonded portions of the parts, since in FIG. 2 the T-shaped joint is formed only be depositing weld metal in the corners without any previous chamferring, and the fluid may be applied to the entire unwelded portion of the weld zone.

While several preferred specific embodiments of the present invention have been set forth for purposes of illustration and for the advantageous details, further embodiments, variations and modifications according to the broader aspects of the present invention are contemplated, all according to the spirit and scope of the following claims.

What is claimed is:

1. A method for improving the fatigue strength in a welded metal structure defined by two metal parts having adjacent surfaces partly welded by depositing weld metal therebetween and partly unwelded between their adjacent surfaces, with the transition from the welded part to the unwelded part representing a fatigue strength stress concentration zone, which method comprises the steps of: feeding a fluid under pressure into the clearance between the unwelded adjacent surfaces of the two parts to locally yield the metal at the stress concentration zone; and thereafter removing the pressurized fluid so that the welded metal structure may be put into practical use.

2. The method according to claim 1, wherein said step of feeding creates a fluid pressure within unwelded part that is substantially greater than $\sigma_1 + \sigma_2\ a/T$, wherein $\sigma_1$ is the design tensile stress and $\sigma_2$ is the design flexural stress expected when the welded structure is placed into practical use, so that such welded structure may not fail under fatigue from such expected stresses.

3. The method according to claim 2, including the further step of heating said fluid prior to its being fed to the unwelded part.

4. The method of claim 3, wherein said fluid is a liquid and said step of heating heats the liquid to a temperature above its atomospheric vaporization temperature and below its pressurized vaporization temperature within the unwelded part sufficient that when the pressurized liquid is removed, any remaining liquid within the unwelded part will be vaporized.

5. The method of claim 1, including the further step of heating said fluid prior to its being fed to the unwelded part.

6. The method of claim 5, wherein said fluid is a liquid and said step of heating heats the liquid to a temperature above its atomospheric vaporization temperature and below its pressurized vaporization temperature within the unwelded part sufficient that when the pressurized liquid is removed, any remaining liquid within the unwelded part will be vaporized.

7. Apparatus for improving the fatigue stength in a welded structure formed by two metal parts having immediately adjacent surfaces defining a welded portion, an unwelded portion and a transition between the welded and unwelded portions forming a stress concentration zone, which comprises: means forming a fluid passage to the unwelded portion; means for feeding a fluid through said passage into said unwelded portion; means for pressurizing the fluid within said unwelded portion sufficiently to form a yielding tensile stress within the metal of said stress concentration zone; and means for removing the pressurized fluid from the unwelded portion.

8. The apparatus of claim 7, further including means for heating the fluid fed into the unwelded portion to a desired temperature.

9. The apparatus of claim 7, including means for heating the fluid to a temperature above its atmospheric vaporization temperature so that when the pressure is removed from the fluid within the unwelded portion, the fluid will vaporize.

* * * * *